US009874095B2

(12) United States Patent
Frederick et al.

(10) Patent No.: US 9,874,095 B2
(45) Date of Patent: Jan. 23, 2018

(54) CUTTING BIT AND EXTRACTION TOOL FOR SAME

(71) Applicant: Joy MM Delaware, Inc., Wilmington, DE (US)

(72) Inventors: John R. Frederick, Allison Park, PA (US); Rudie Boshoff, Warrendale, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 0 days.

(21) Appl. No.: 15/095,996

(22) Filed: Apr. 11, 2016

(65) Prior Publication Data

US 2016/0298454 A1 Oct. 13, 2016

Related U.S. Application Data

(60) Provisional application No. 62/145,603, filed on Apr. 10, 2015, provisional application No. 62/202,573, filed on Aug. 7, 2015.

(51) Int. Cl.

| | |
|---|---|
| ***E21C 35/18*** | (2006.01) |
| ***E21C 35/197*** | (2006.01) |
| ***E21C 25/10*** | (2006.01) |

(52) U.S. Cl.

CPC ..... *E21C 35/197* (2013.01); *E21C 25/10* (2013.01); *E21C 35/18* (2013.01)

(58) Field of Classification Search

CPC ..... B28D 1/188; E21C 35/18; E21C 35/19; E21C 35/1933; E21C 35/197; E21C 2035/191; E21C 2035/1826

(Continued)

(56) References Cited

U.S. PATENT DOCUMENTS

| | | | |
|---|---|---|---|
| 1,000,475 | A | 8/1911 | Woodson |
| 4,149,753 | A | 4/1979 | Stoltz et al. |

(Continued)

FOREIGN PATENT DOCUMENTS

| | | | |
|---|---|---|---|
| CN | 201180542 | Y * | 1/2009 |
| DE | 202009014077 | U1 * | 4/2010 |
| WO | WO 2011048006 | A2 * | 4/2011 |

OTHER PUBLICATIONS

"Underground Mining", Kennametal Catalog, 182 pages, 2014, Kennametal Inc., Latrobe, PA.

(Continued)

*Primary Examiner* — Sunil Singh

(74) *Attorney, Agent, or Firm* — Michael Best & Friedrich LLP

(57) ABSTRACT

A cutting bit for a bit assembly secured to a cutter head includes a cutting end, a shank extending along a bit axis, and a shoulder positioned between the cutting end and the shank. The shoulder includes an outer edge defining a perimeter, a shoulder end surface defining a shoulder plane, a first inclined surface and a second inclined surface. The first inclined surface is positioned between the outer edge and the shoulder end surface. The first inclined surface extends along the perimeter and is oriented at a first acute angle relative to the shoulder plane. The second inclined surface is positioned between the shoulder end surface and the first inclined surface. The second inclined surface is oriented at a second acute angle relative to the shoulder plane, and the second acute angle is smaller than the first acute angle.

33 Claims, 13 Drawing Sheets

(58) Field of Classification Search
USPC ..... 299/79.1, 85.2, 87.1, 100–111, 112 R, 299/112 T, 113
See application file for complete search history.

(56) References Cited

U.S. PATENT DOCUMENTS

| | | | |
|---|---|---|---|
| 4,649,613 | A | 3/1987 | Bednarik |
| 5,374,111 | A | 12/1994 | Den Besten et al. |
| 6,585,326 | B2 | 7/2003 | Sollami |
| 6,886,229 | B1 | 5/2005 | Wilson |
| 7,195,321 | B1 | 3/2007 | Sollami |
| 7,735,806 | B2 | 6/2010 | Prater et al. |
| 8,117,702 | B2 | 2/2012 | Woolley et al. |
| 2006/0022510 | A1 | 2/2006 | Sansone et al. |
| 2010/0018776 | A1 | 1/2010 | Keller et al. |
| 2010/0170072 | A1 | 7/2010 | Elzey |
| 2010/0253130 | A1 | 10/2010 | Sollami |
| 2012/0001475 | A1 | 1/2012 | Dubay et al. |
| 2012/0181845 | A1 | 7/2012 | Sollami |

OTHER PUBLICATIONS

PCT/US2016/026976 International Search Report and Written Opinion dated Jul. 29, 2016 (14 pages).

* cited by examiner

FIG. 10
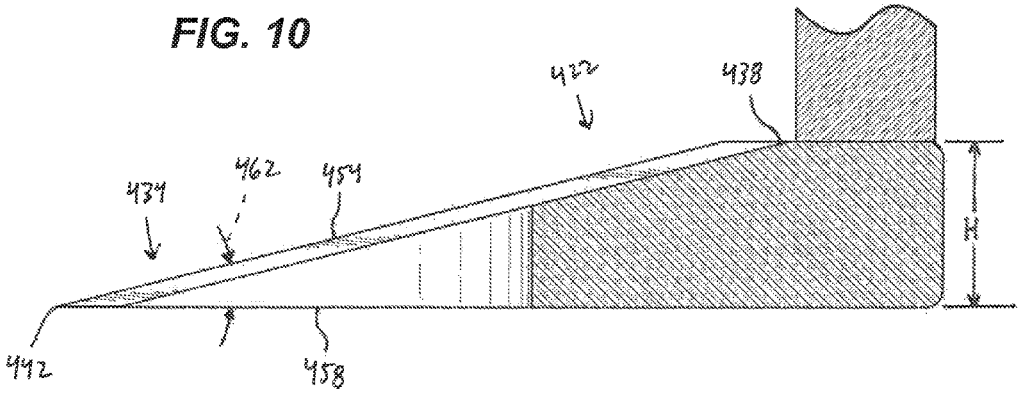
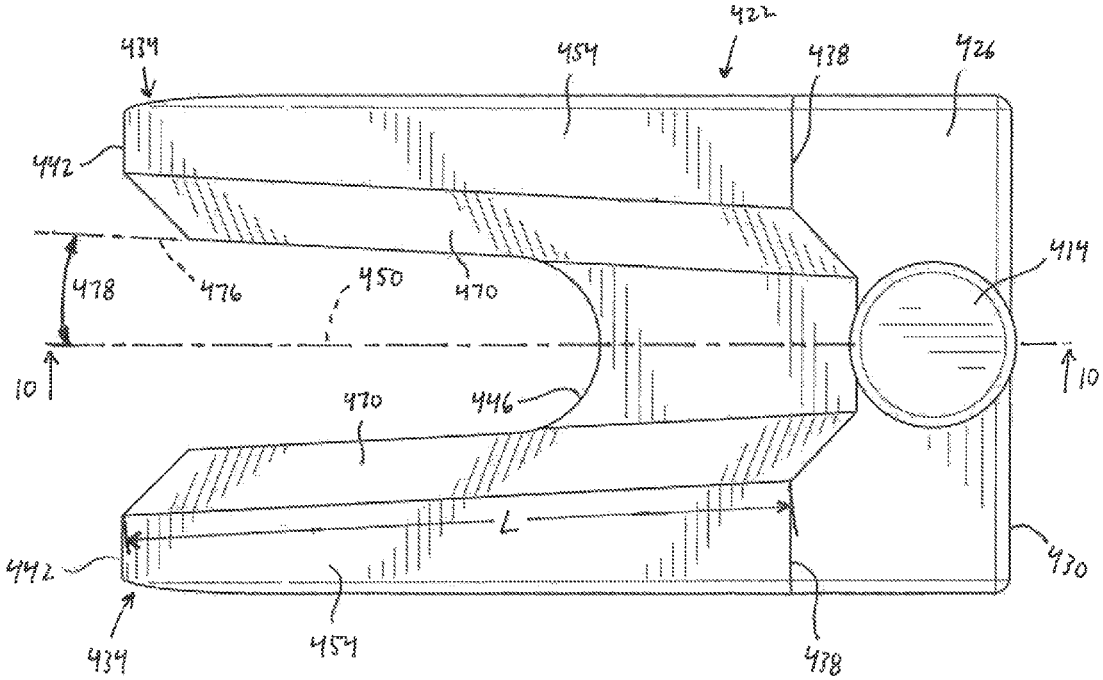
FIG. 9

CUTTING BIT AND EXTRACTION TOOL FOR SAME

CROSS-REFERENCE TO RELATED APPLICATIONS

This application claims the benefit of and priority to prior-filed, U.S. Provisional Application No. 62/145,603, filed Apr. 10, 2015, and U.S. Provisional Application No. 62/202,573, filed Aug. 7, 2015. The entire contents of these documents are hereby incorporated by reference herein.

BACKGROUND

The present application relates to cutting bits, and particularly to a cutting bit for an industrial machine and an extraction tool for the cutting bit.

Conventional continuous mining, longwall mining machines, and entry development machines include a cutter head including multiple cutting bit assemblies. In some embodiments, each cutting bit assembly includes a bit holder block coupled to a rotating drum. The bit holder block also includes a slot. In some embodiments, the slot receives a sleeve. The sleeve includes a bore and an outer surface engaging the slot of the bit holder block. A bit is secured within the bore of the sleeve.

SUMMARY

In one aspect, a bit assembly for a cutting drum includes a sleeve and a bit. The sleeve includes shank portion, a flange positioned adjacent an end of the shank portion, and a bore extending through the flange and the shank portion. The flange includes a flange end surface. The bit includes a cutting end, a shank, and a shoulder positioned between the cutting end and the shank. At least a portion of the shank is positioned within the bore of the sleeve. The shank extends along a bit axis. The shoulder is positioned adjacent the end surface of the flange and includes an edge. A shoulder end surface defines a shoulder plane, a first inclined surface, and a second inclined surface. The edge extends along a perimeter of the shoulder. The first inclined surface is positioned between the edge and the shoulder end surface. The first inclined surface extends along the perimeter and is oriented at a first angle relative to the shoulder plane. The second surface is positioned between the shoulder end surface and the first inclined surface. The second inclined surface is oriented at a second angle relative to the shoulder plane. The first angle is larger than the second angle.

In another aspect, a cutting bit is provided for a bit assembly secured to a cutter head. The cutting bit includes a cutting end, a shank extending along a bit axis, and a shoulder positioned between the cutting end and the shank. The shoulder includes an outer edge defining a perimeter, a shoulder end surface defining a shoulder plane, a first inclined surface and a second inclined surface. The first inclined surface is positioned between the outer edge and the shoulder end surface. The first inclined surface extends along the perimeter and is oriented at a first acute angle relative to the shoulder plane. The second inclined surface is positioned between the shoulder end surface and the first inclined surface. The second inclined surface is oriented at a second acute angle relative to the shoulder plane, and the second acute angle is smaller than the first acute angle.

In yet another aspect, an extraction tool is provided for removing a portion of a cutting bit assembly of a cutter head. The cutting bit assembly including a bit having a shoulder end surface abutting an end surface of one of a sleeve and a bit holder. The extraction tool including a shaft and a head. The shaft includes a first end and a second end. The head is coupled to the second end of the shaft. The head includes a body and a pair of fingers extending away from the body. The body includes a face end surface. Each of the fingers includes a base end connected to the body and a distal end positioned away from the body, and the fingers are spaced apart from one another by a gap. A groove is formed between the base ends of the fingers. The head defines a plane positioned laterally between the fingers such that one of the fingers is positioned on one side of the plane and the other finger is positioned on the other side of the plane. Each finger further includes an upper surface and an inclined surface. The inclined surface extends at least partially between the distal end and the base end, and the inclined surface tapers inwardly toward the plane such that a first distance between the inclined surface and the plane proximate the distal end is greater than a second distance between the inclined surface and the plane proximate the groove. The inclined surface also tapers inwardly toward the plane from the upper surface such that a first offset distance between an upper edge of the inclined surface and the plane is greater than a second offset distance between a lower edge of the inclined surface and the plane.

Other aspects will become apparent by consideration of the detailed description and accompanying drawings.

BRIEF DESCRIPTION OF THE DRAWINGS

FIG. 9 is a top view of the extraction tool of FIG. 8.

FIG. 10 is a section view of the extraction tool of FIG. 9 viewed along section 10-10.

DETAILED DESCRIPTION

Before any embodiments are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical or hydraulic connections or couplings, whether direct or indirect. Also, electronic communications and notifications may be performed using any known means including direct connections, wireless connections, etc.

Figure 1:
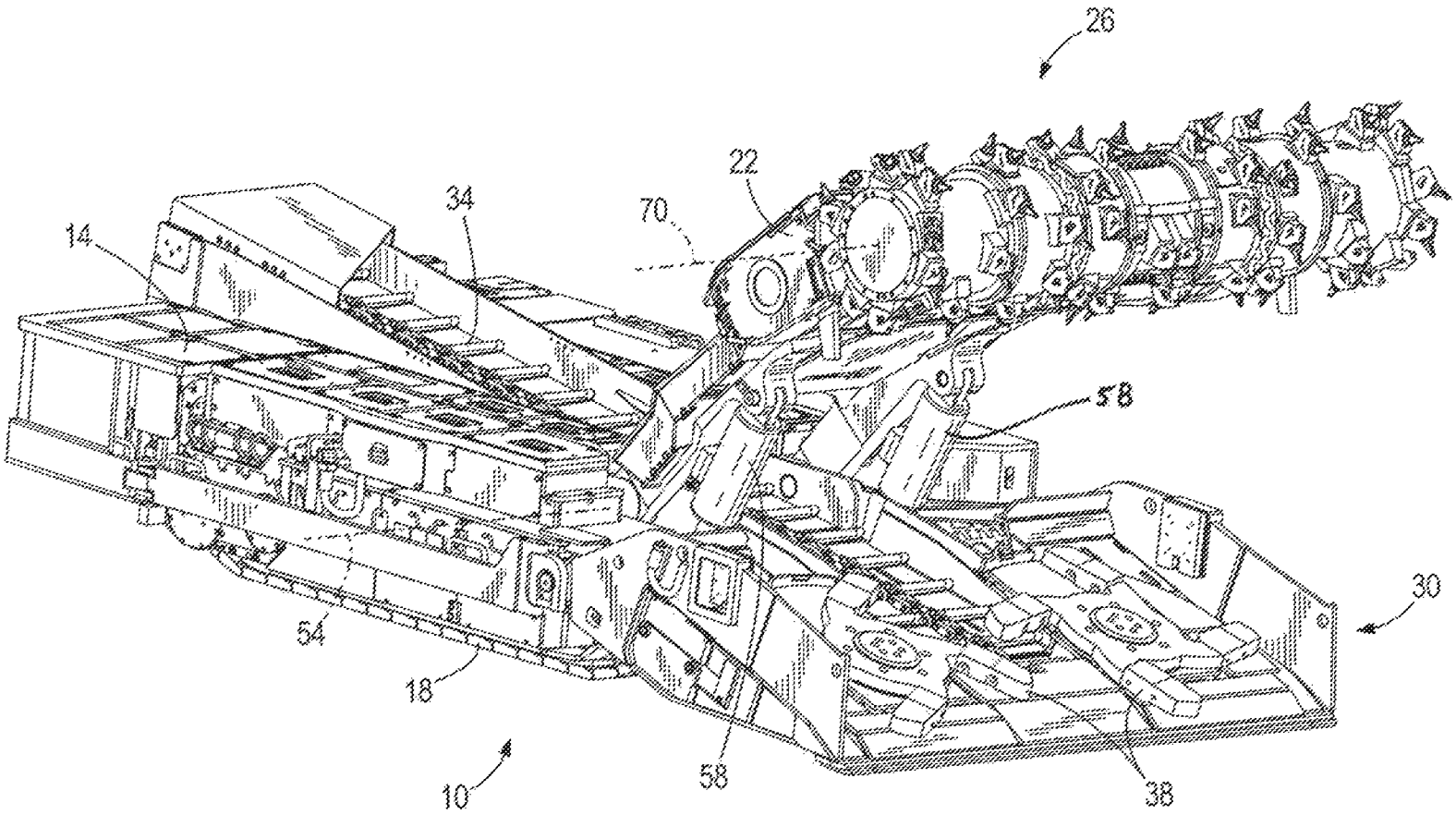
FIG. 1 is a perspective view of a mining machine.

FIG. 1 illustrates a mining machine, such as a continuous miner 10, including a frame 14 that is supported for movement (e.g., by tracks 18). The continuous miner 10 further includes a boom 22 and a cutter head 26 supported on the boom 22. In the illustrated embodiment, the frame 14 also includes a collecting mechanism or gathering head 30 and a conveyor 34 extending from a first or front end of the frame 14 toward a second or rear end of the frame 14. In the illustrated embodiment, the gathering head 30 includes a pair of rotating arms 38 that engage cut material below the cutter head 26 and direct the cut material onto the conveyor 34. The conveyor 34 transports the cut material along a longitudinal axis of the frame 14, from the area below the cutter head 26 to a second conveyor (not shown) positioned proximate the second end of the frame 14.

The boom 22 includes one end pivotably coupled to the frame 14 and another end supporting the cutter head 26. The boom 22 is pivotable about a pivot axis 54 that is generally transverse to the longitudinal axis of the frame 14. The boom 22 is pivoted by a pair of actuators 58 that are coupled between the frame 14 and the boom 22. In the illustrated embodiment, the actuators 58 are hydraulic jacks or cylinders.

Figure 2:
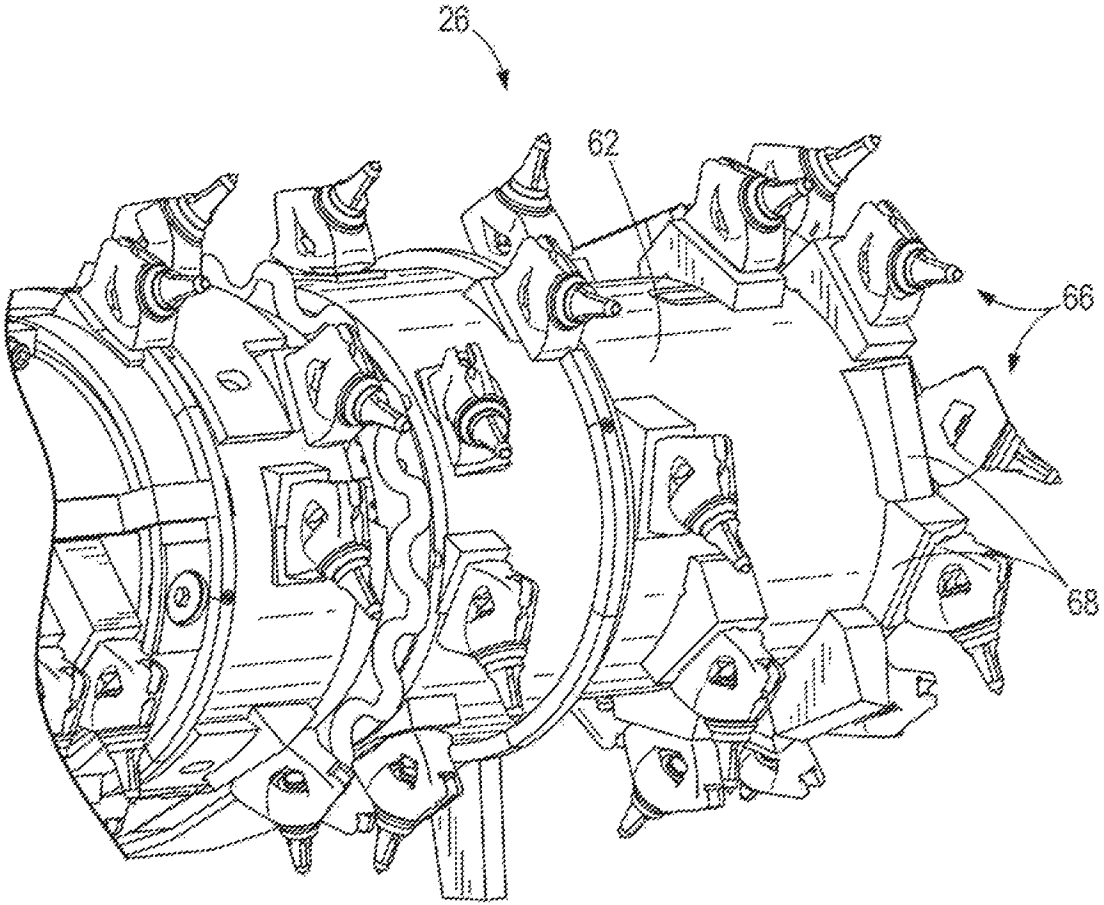
FIG. 2 is a perspective view of a portion of a cutter head.

As shown in FIG. 2, the cutter head 26 is formed as an elongated drum 62 including cutting bit assemblies 66 secured to an outer surface of the drum 62. In the illustrated embodiment, the outer surface of the drum 62 includes multiple pedestals 68, and each cutting bit assembly 66 is secured to one of the pedestals 68. The drum 62 defines a drum axis 70 (FIG. 1) that is generally parallel to the pivot axis 54 of the boom 22, and the drum 62 is rotatable about the drum axis 70.

Figure 3:
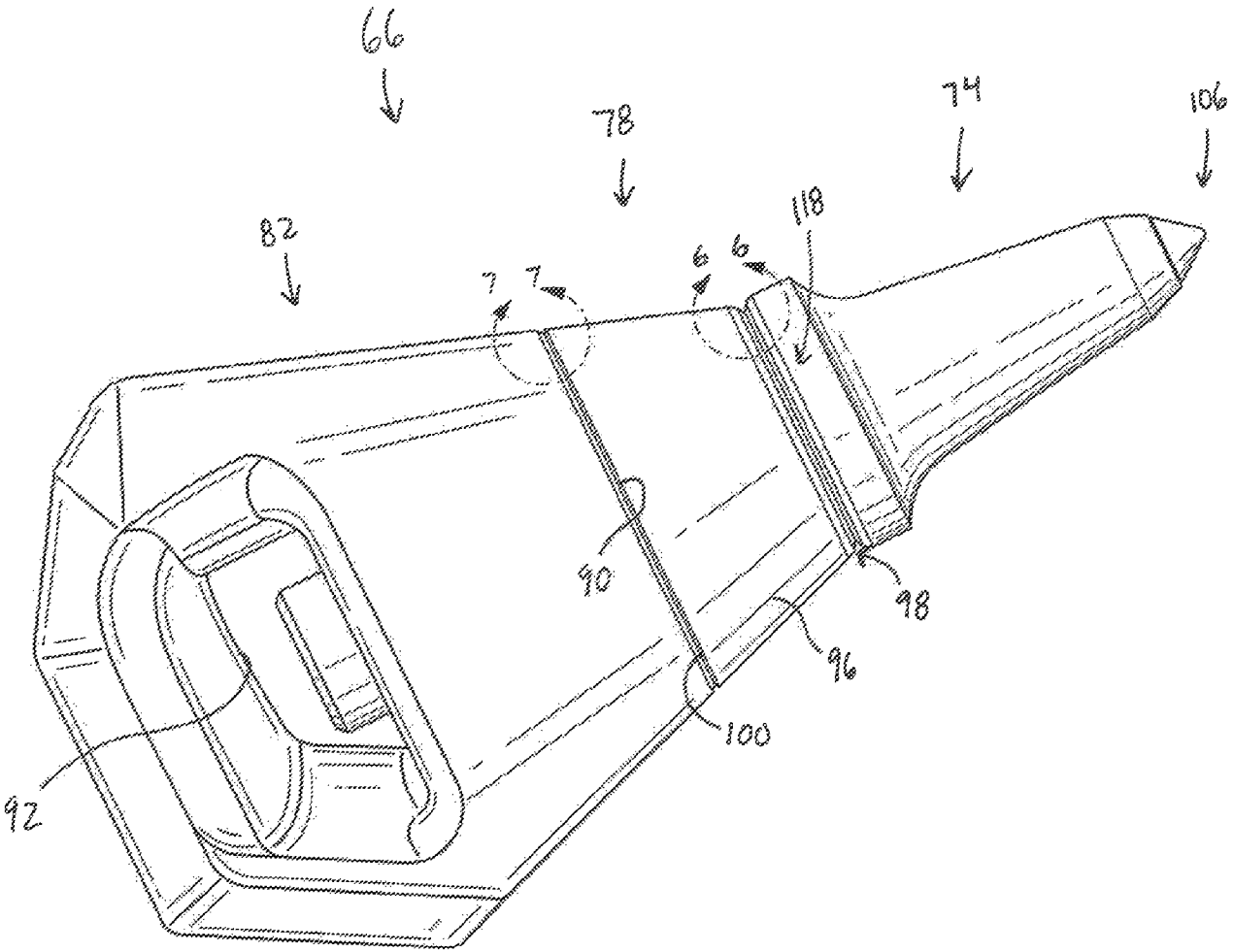
FIG. 3 is a side view of a cutting bit assembly.

FIG. 3 illustrates a cutting bit assembly 66 according to one embodiment. Each cutting bit assembly 66 includes a bit 74, a sleeve 78, and a holder or holder block 82. The block 82 includes a bore or opening (not shown), and the sleeve 78 is received within the opening. The block 82 has an end surface or forward surface 90. In the embodiment of FIG. 3, the holder block 82 has a profile that generally coincides or corresponds to the profile of the sleeve 78. In still other embodiments, the holder profile may have another shape. Also, the block 82 may incorporate a nozzle aperture (not shown) for supporting a fluid spray nozzle. The nozzle can provide a spray envelope that encompasses a portion of the bit 74. The block 82 also includes a lateral opening 92 through which a rear end of the bit 74 is accessible.

The sleeve 78 includes an elongated shank portion 94 (FIG. 6B) and a flange 96. In the illustrated embodiment, the shank portion 94 has a generally cylindrical shape and is positioned within the opening of the block 82. The flange 96 includes a first end surface or forward surface 98 and a second end surface or rear surface 100. The rear surface 100 of the flange 96 is positioned adjacent the forward surface 90 of the holder block 82. In the illustrated embodiment, the rear surface 100 of the flange 96 abuts or contacts at least a portion of the forward surface 90 of the holder block 82. In the illustrated embodiment, the sleeve 78 includes an outer surface defining a profile that generally coincides with or corresponds to the profile of the outer surface of the bit 74 as well as the outer surface of the block 82. In other embodiments, the sleeve profile may have other shapes, such as a curved shape having a non-linear taper. The sleeve 78 also defines a bore (not shown) extending through the length of the sleeve 78.

Figure 4:
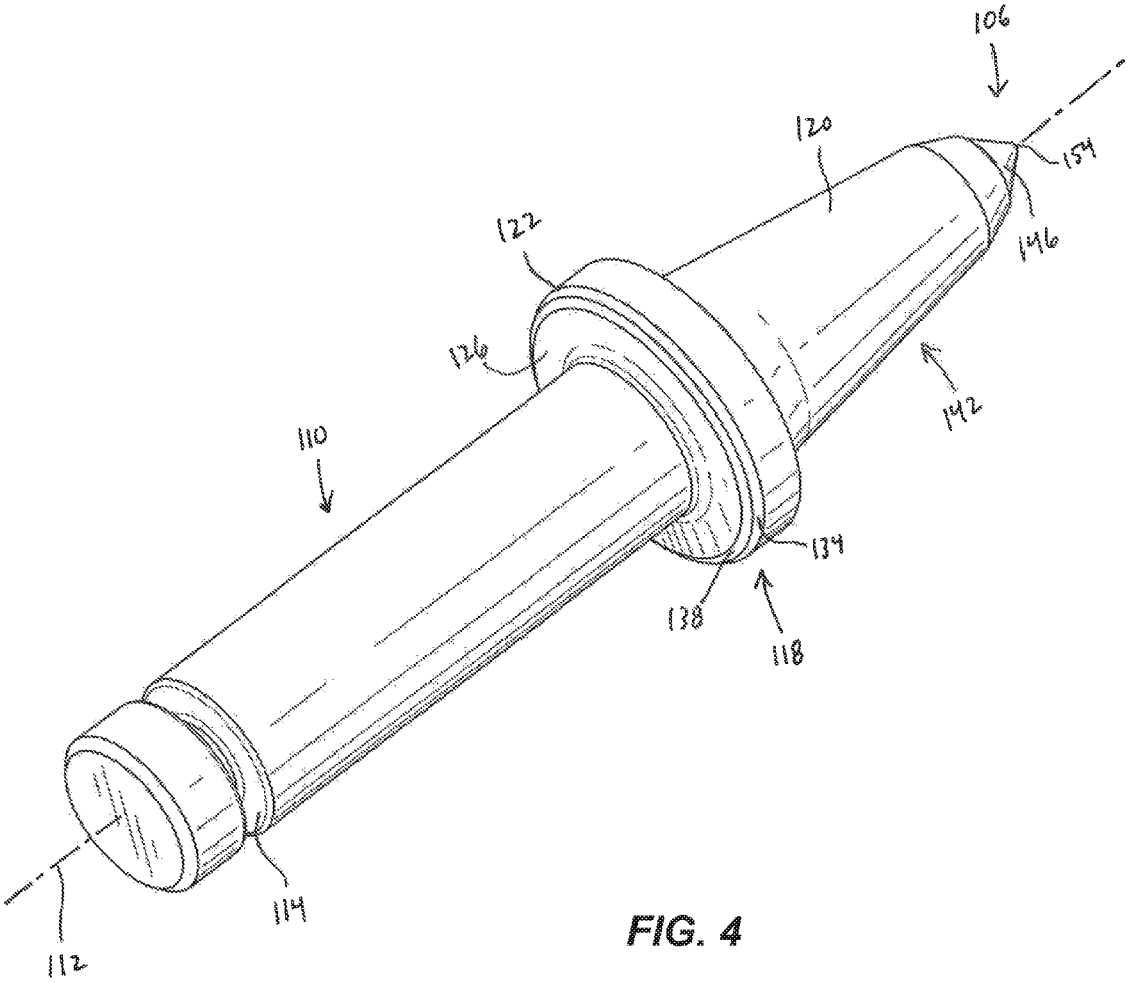
FIG. 4 is a perspective view of a cutting bit.
Figure 5:
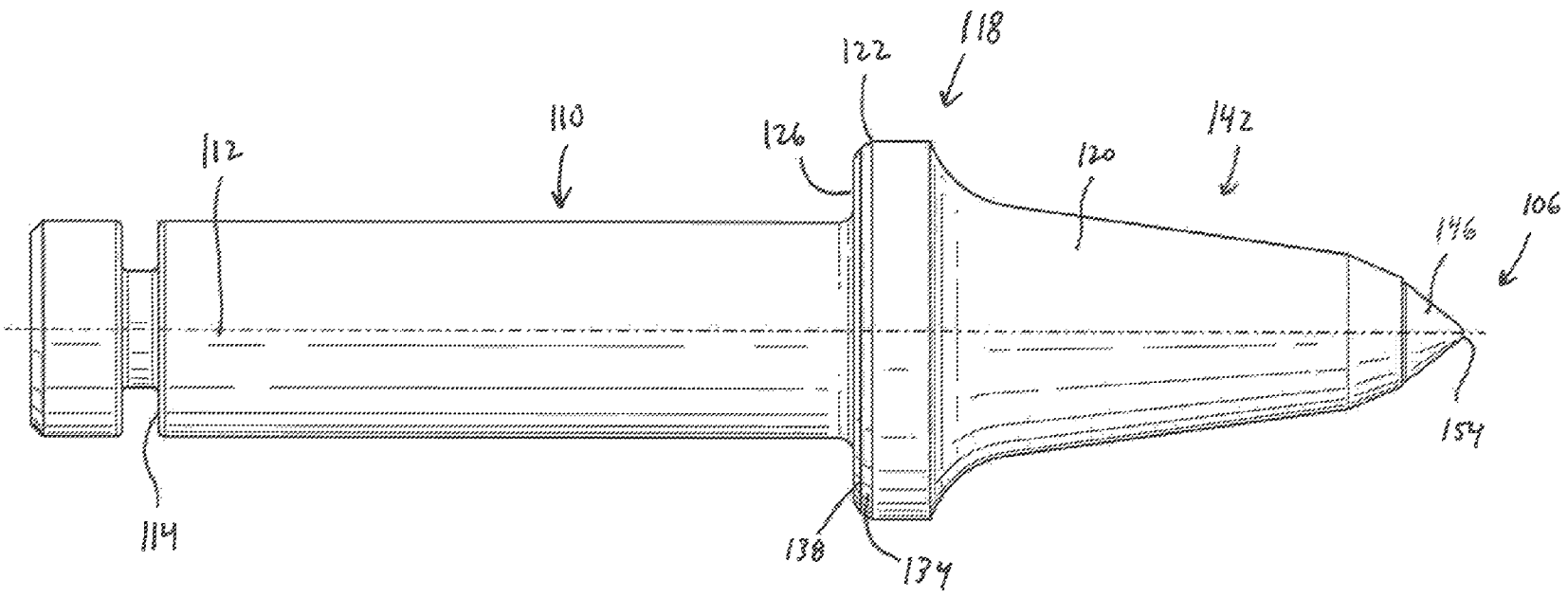
FIG. 5 is a side view of the cutting bit of FIG. 4.

Referring to FIGS. 4 and 5, the bit 74 includes a cutting end 106 and a shank 110. The shank 110 is positioned within the bore of the sleeve 78, and the shank 110 defines a shank axis or bit axis 112. In some embodiments, an end of the shank 110 protrudes from the end of the sleeve 78 and includes a slot 114. The slot 114 receives a retaining mechanism (e.g., by a cotter pin or hairpin clip—not shown) for securing the bit 74 against axial movement relative to the sleeve 78. Unless otherwise specified, the term "axial" refers to a direction extending parallel to the bit axis 112 and the term "radial" refers to a direction extending perpendicularly to the bit axis 112.

The bit 74 also includes a shoulder 118 positioned between the cutting end 106 and the shank 110. A portion of the bit 74 extending between the shoulder 118 and the cutting end 106 has an outer surface 120 defining a bit profile. The shoulder 118 includes an edge 122 defining an outer perimeter of the shoulder 118 and a shoulder end surface 126. In the illustrated embodiment, the shoulder end surface 126 extends around the end of the shank 110. In addition, the shoulder 118 includes a first inclined surface 134 and a second inclined surface 138. In the illustrated embodiment, the first inclined surface 134 is positioned adjacent the edge 122 and extends radially along the entire perimeter of the shoulder 118. In the illustrated embodiment, the second inclined surface 138 is positioned between the first inclined surface 134 and the shoulder end surface 126 and extends radially along the entire perimeter of the shoulder 118. In other embodiments, the first inclined surface 134 may extend along the outer perimeter but may not be contiguous with the edge 122. Similarly, in other embodiments, the second inclined surface 138 may extend along the perimeter of the shoulder 118 but may not be contiguous with the edge of the shoulder end surface 126. The inclined surfaces 134, 138 will be discussed in further detail below.

Referring again to FIG. 3, the shoulder 118 is positioned adjacent the forward surface 98 of the sleeve flange 96. In the illustrated embodiment, the shoulder 118 abuts or contacts at least a portion of the forward surface 98. In the illustrated embodiment, the bit profile has a curved shape that tapers in a non-linear manner between the cutting end 106 and the shoulder 118. In other embodiments, the bit 74 may have a different shape.

As shown in FIGS. 4 and 5, in the illustrated embodiment, the bit 74 includes a bit body 142 and an insert 146 positioned in an opening on the cutting end 106 of the bit body 142. The insert 146 forms a cutting tip 154. In one embodiment, the insert 124 is made from tungsten carbide. In other embodiments, the insert 124 may be formed from another material. In other embodiments, the bit 74 may be formed without an insert, such that the cutting end 106 of the bit body 142 forms a cutting tip.

Figure 6:
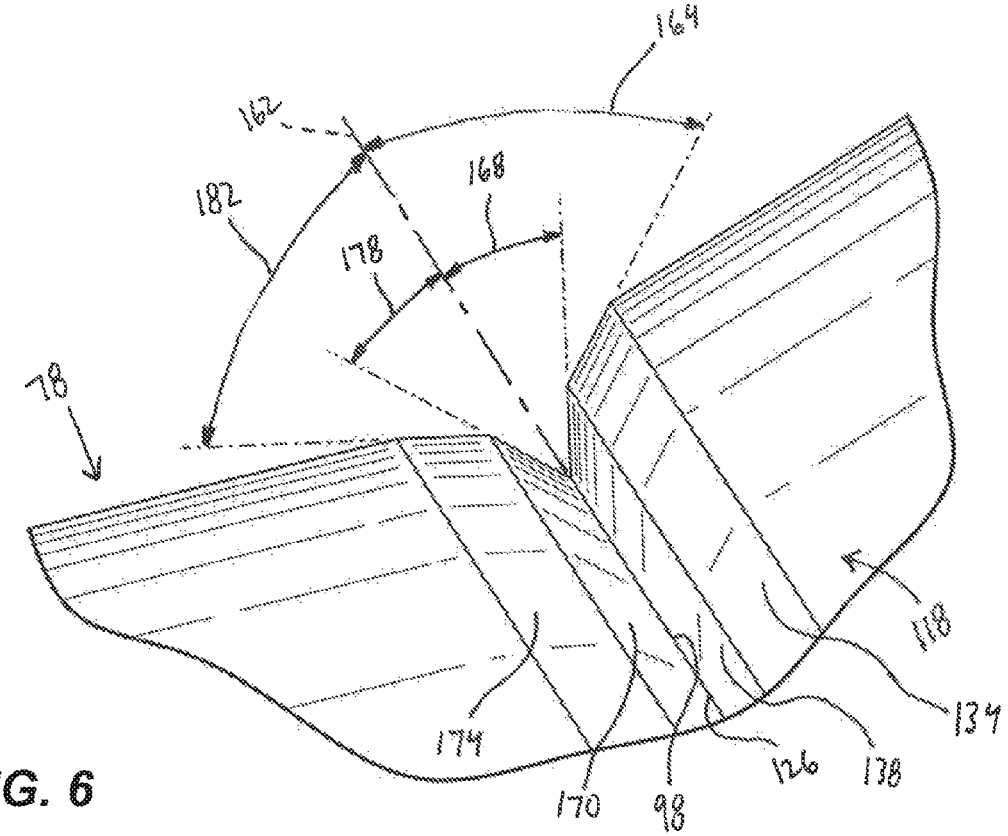
FIG. 6 is an enlarged side view of area 6-6 of the cutting bit assembly of FIG. 3.

FIG. 6 illustrates the interface between the shoulder 118 and the sleeve 78. In the illustrated embodiment, the shoulder end surface 126 defines a shoulder plane 162 and abuts the forward surface 98 of the flange 96. In the illustrated embodiment, the shoulder plane 162 is perpendicular to the bit axis 112 (FIG. 4). The shoulder 118 is positioned on one side of the shoulder plane 162 and the sleeve flange 96 is positioned on the other. The first inclined surface 134 forms a first angle 164 relative to the shoulder plane 162 and the second inclined surface 138 forms a second angle 168 relative to the shoulder plane 162.

In some embodiments, the first angle 164 is between approximately 45 degrees and 80 degrees. In some embodiments, the first angle 164 is between approximately 60 degrees and approximately 70 degrees. In some embodiments, the first angle 164 is approximately 65 degrees.

In some embodiments, the second angle 168 is between approximately 5 degree and approximately 30 degrees. In some embodiments, the second angle 168 is between approximately 5 degrees and approximately 20 degrees. In some embodiments, the second angle 168 is between approximately 10 degrees and approximately 15 degrees. In some embodiments, the second angle 168 is approximately 11 degrees.

In addition, in the illustrated embodiment the flange 96 further includes a third inclined surface 170 adjacent the forward end surface 98 and a fourth inclined surface 174 adjacent the third inclined surface 170. The third inclined surface 170 is positioned radially between the fourth inclined surface 174 and the forward end surface 98. The third inclined surface forms a third angle 178 relative to the shoulder plane 162, and the fourth inclined surface forms a fourth angle 182 relative to the shoulder plane 162.

In some embodiments, the third angle 178 is between approximately 5 degree and approximately 30 degrees. In some embodiments, the third angle 178 is between approximately 5 degrees and approximately 20 degrees. In some embodiments, the third angle 178 is between approximately 10 degrees and approximately 15 degrees. In some embodiments, the third angle 178 is approximately 11 degrees. In the illustrated embodiment, the third angle 178 is substantially equal to the second angle 168. The third angle 178 and the second angle 168 may form a combined wedge angle. In some embodiments, the combined wedge angle is between approximately 15 degrees and approximately 45 degrees. In some embodiments, the combined wedge angle is between 20 degrees and 35 degrees. In some embodiments, the combined wedge angle is between 20 degrees and 30 degrees. In some embodiments, the combined wedge angle is approximately 22 degrees.

In some embodiments, the fourth angle 182 is between approximately 45 degrees and 80 degrees. In some embodiments, the fourth angle 182 is between approximately 60 degrees and approximately 70 degrees. In some embodiments, the fourth angle 182 is approximately 65 degrees. In the illustrated embodiment, the fourth angle 182 is substantially equal to the first angle 164.

Figure 6B:
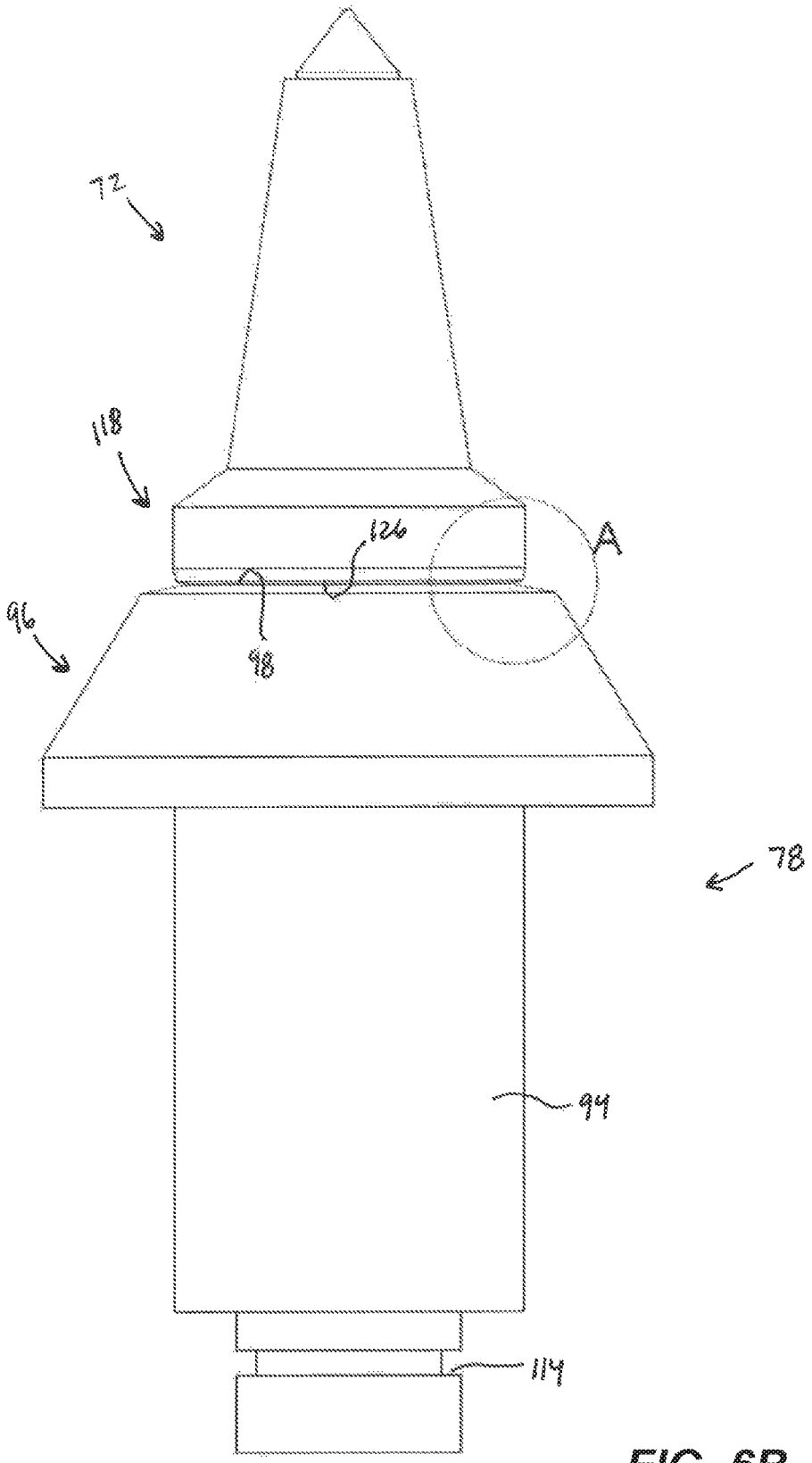
FIG. 6B is a side view of a cutting bit and a sleeve according to another embodiment.
Figure 6C:
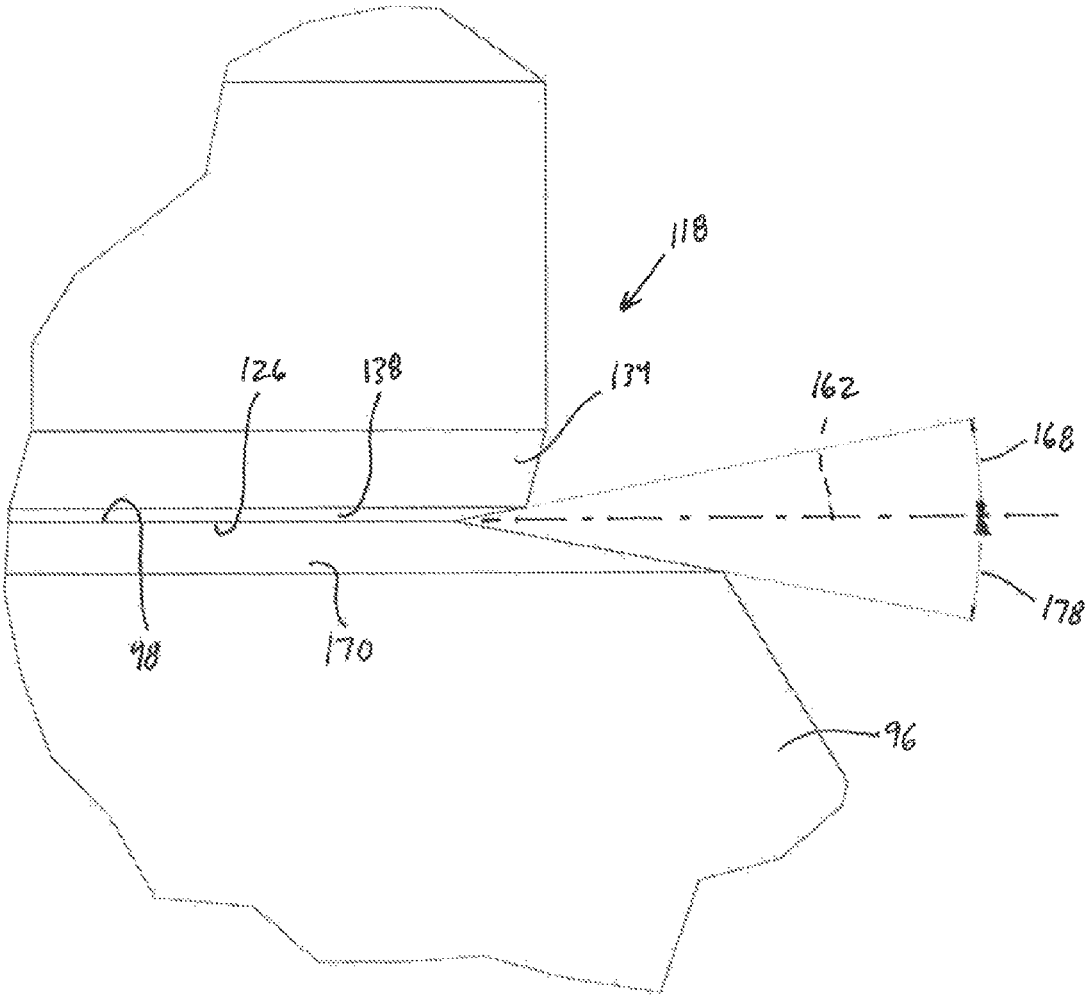
FIG. 6C is an enlarged side view of area 6C-6C of the cutting bit and sleeve of FIG. 6B.
Figure 8:
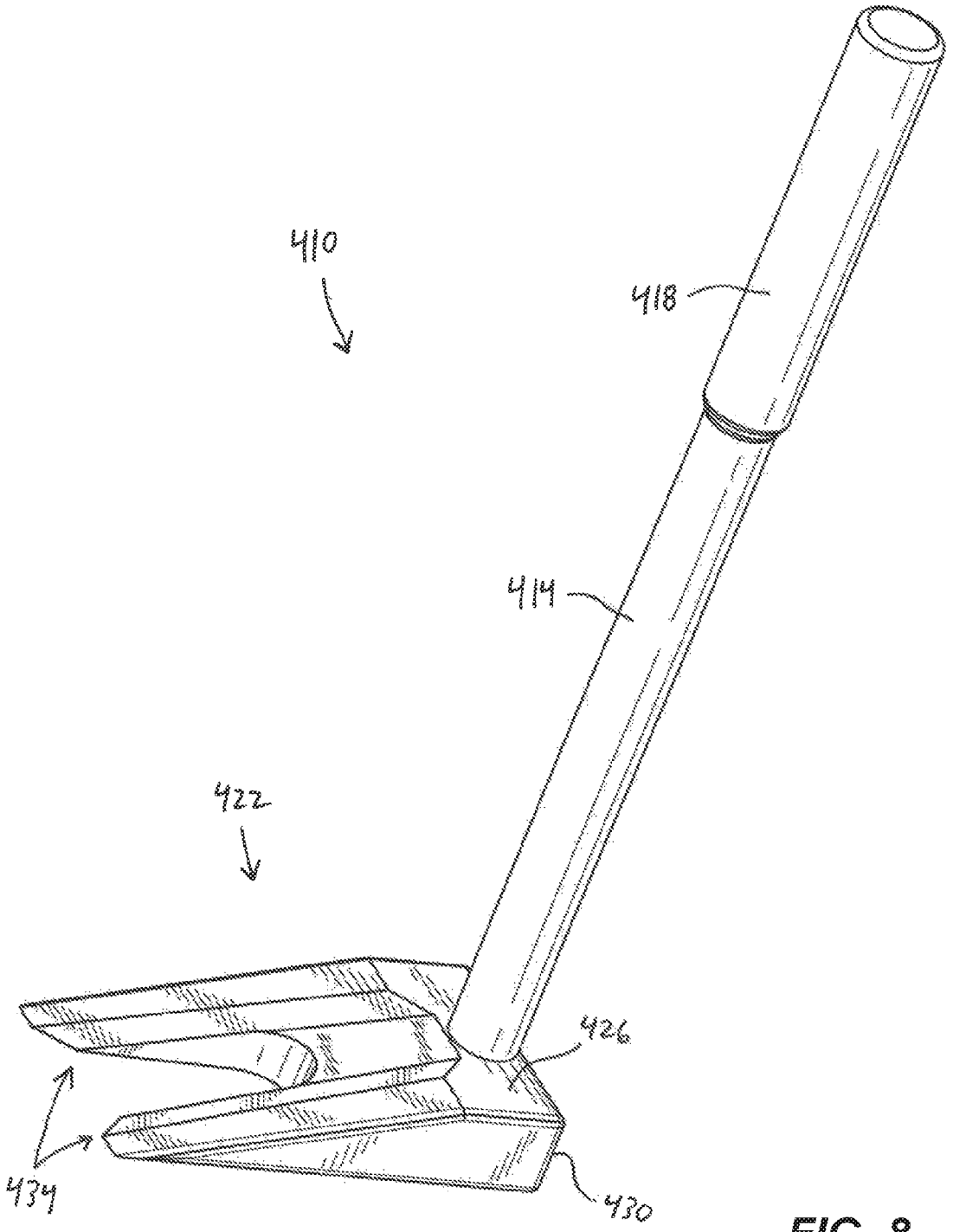
FIG. 8 is a perspective view of an extraction tool.

In other embodiments, the flange 96 may be formed without the third or fourth inclined surfaces 170, 174. For example, as shown in FIGS. 6B and 6C, the sleeve 78 may include only the third inclined surface 170.

Figure 7:
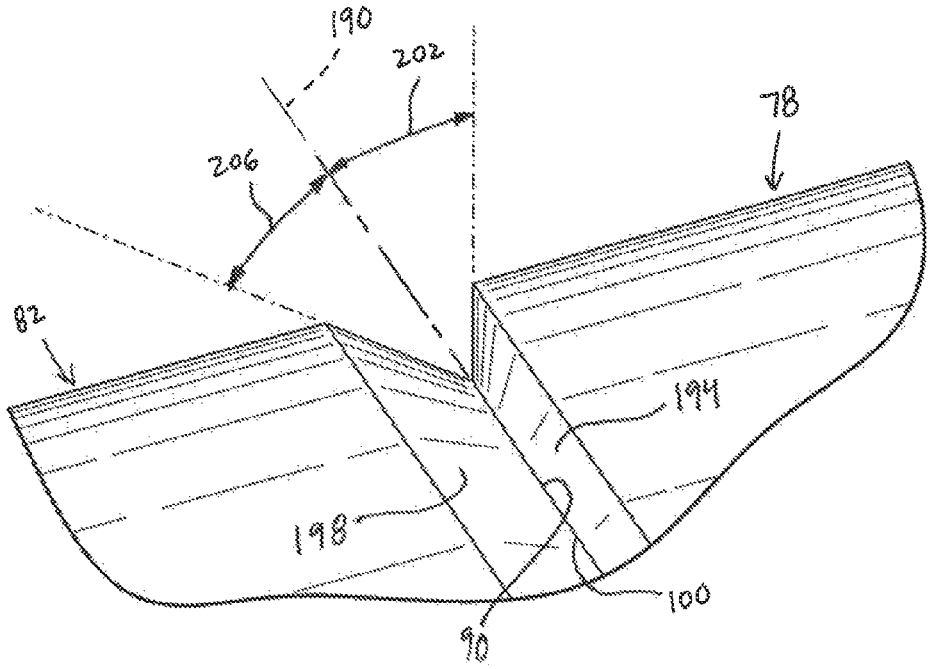
FIG. 7 is an enlarged side view of area 7-7 of the cutting bit assembly of FIG. 3.

Referring to FIG. 7, the rear surface 100 of the flange 96 and the forward surface 90 of the block 82 abut one another, and the rear surface 100 defines a flange plane 190. In the illustrated embodiment, a rear inclined surface 194 extends around the rear surface 100 of the flange 96, and an inclined block surface 198 extends around at least a portion of the forward surface 90 of the block 82. The rear inclined surface 194 forms a flange angle 202 relative to the flange plane 190, and the inclined block surface 198 forms a block angle 206 relative to the flange plane 190.

In some embodiments, the flange angle 202 is between approximately 5 degree and approximately 40 degrees. In some embodiments, the flange angle 202 is between approximately 5 degrees and approximately 30 degrees. In some embodiments, the flange angle 202 is between approximately 5 degrees and approximately 22.5 degrees. In some embodiments, the flange angle 202 is between approximately 10 degrees and approximately 22.5 degrees. In some embodiments, the flange angle 202 is between approximately 10 degrees and approximately 15 degrees. In some embodiments, the flange angle 202 is approximately 15 degrees. In some embodiments, the flange angle 202 is approximately 11 degrees.

In some embodiments, the block angle 206 is between approximately 5 degree and approximately 40 degrees. In some embodiments, the block angle 206 is between approximately 5 degrees and approximately 30 degrees. In some embodiments, the block angle 206 is between approximately 5 degrees and approximately 22.5 degrees. In some embodiments, the block angle 206 is between approximately 10 degrees and approximately 22.5 degrees. In some embodiments, the block angle 206 is between approximately 10 degrees and approximately 15 degrees. In some embodiments, the block angle 206 is approximately 15 degrees. In some embodiments, the block angle 206 is approximately 11 degrees.

In some embodiments, the block angle 206 is substantially equal to the flange angle 202, and the block angle 206 and the flange angle 202 form a combined angle. In some embodiments, the combined angle is between approximately 15 degrees and approximately 45 degrees. In some embodiments, the combined angle is between 20 degrees and 35 degrees. In some embodiments, the combined angle is between 20 degrees and 30 degrees. In some embodiments, the combined angle is approximately 22 degrees.

Although the forward surface 90 of the block 82 and the rear surface 100 of the flange 96 each include a single inclined surface in FIG. 7, it is understood that multiple inclined surfaces could be formed on each component, similar to the structure shown in FIG. 6. Similarly, it is understood that the shoulder 118 of the bit 74 and the forward surface 98 of the flange 96 may each be formed with a single inclined surface.

Also, in some embodiments, the cutting bit assembly 66 may be formed without a sleeve such that the bit 74 is secured directly to the block 82. In such a configuration, the forward surface 90 of the block 82 may be formed to include multiple inclined surfaces similar to the structure shown in FIG. 6.

The multiple inclined surfaces between the shoulder 118 and the flange 96 provide a space for an operator to insert an edge of a prying tool or extraction tool in order to apply force and extract the bit 74 from the sleeve 78. In particular, the shallow second angle 168 of the second inclined surface 138 provides significant mechanical advantage when the working end of an extraction tool engages the second inclined surface 138. Typically, an impact force is applied (e.g., by striking a hammer) against an end of the extraction tool. In some embodiments, the shallow second angle 168 multiplies this impact force by a factor of four or more, thereby allowing an operator to remove the bit 74 from the sleeve 76 without excessive effort. In addition, because the inclined surfaces 134, 138 extend along the entire perimeter of the shoulder 118, the working end of the extraction tool may be inserted at any radial position between the bit 74 and the sleeve 78. This is in contrast to some conventional bits, which may only include notches at predetermined points on an outer perimeter of the bit. After use, the notches may not be readily accessible by the tool.

FIGS. 8-12 illustrate an extraction tool 410 according to one embodiment. The extraction tool 410 includes a shaft 414, a handle 418 coupled to a first end of the shaft 414, and a head 422 coupled to a second end of the shaft 414. The head 422 includes a body 426 defining a face end surface 430. In addition, the head 422 includes a pair of claws or tines or fingers 434 extending outwardly from the body 426.

As shown in FIG. 9, each finger 434 includes a base end 438 attached to the body 426 and a distal end 442. In the illustrated embodiment, the fingers 434 are parallel to one another and separated by a gap. A valley or groove 446 is formed between the fingers 434 and extends between the fingers 434 proximate the base ends 438. In the illustrated embodiment, the groove 446 has a curved profile. In addition, a first plane 450 extends away from the body 426 and is positioned between the fingers 434. In the illustrated embodiment, the first plane 450 bisects the head 422 along a line of symmetry.

As shown in FIG. 10, each finger 434 includes an upper surface 454 that is inclined downwardly from the base end 438 toward the distal end 442. Stated another way, a height between the upper surface 454 and a lower surface 458 proximate the base end 438 is larger than a height between the upper surface 454 and the lower surface 458 proximate the distal end 442. The upper surface 454 forms a finger angle 462 relative to the lower surface 458. In some embodiments, the finger angle 462 is between approximately 10 degrees and approximately 30 degrees. In some embodiments, the finger angle 462 is between approximately 10 degrees and approximately 20 degrees. In some embodiments, the finger angle 462 is approximately 14 degrees.

Figure 11:
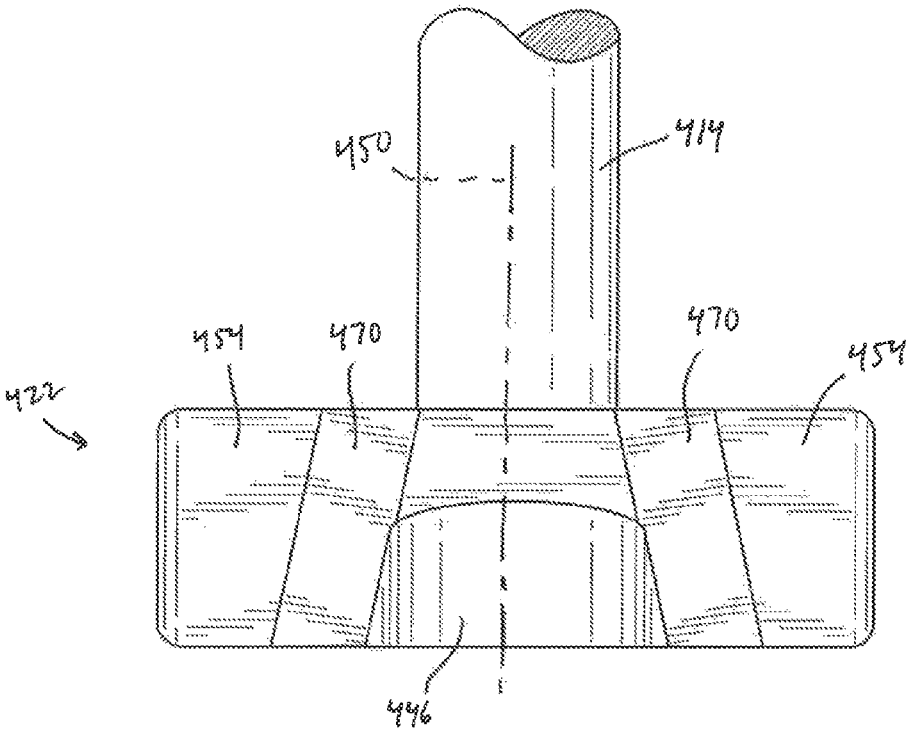
FIG. 11 is a front view of a portion of the extraction tool of FIG. 8.
Figure 12:
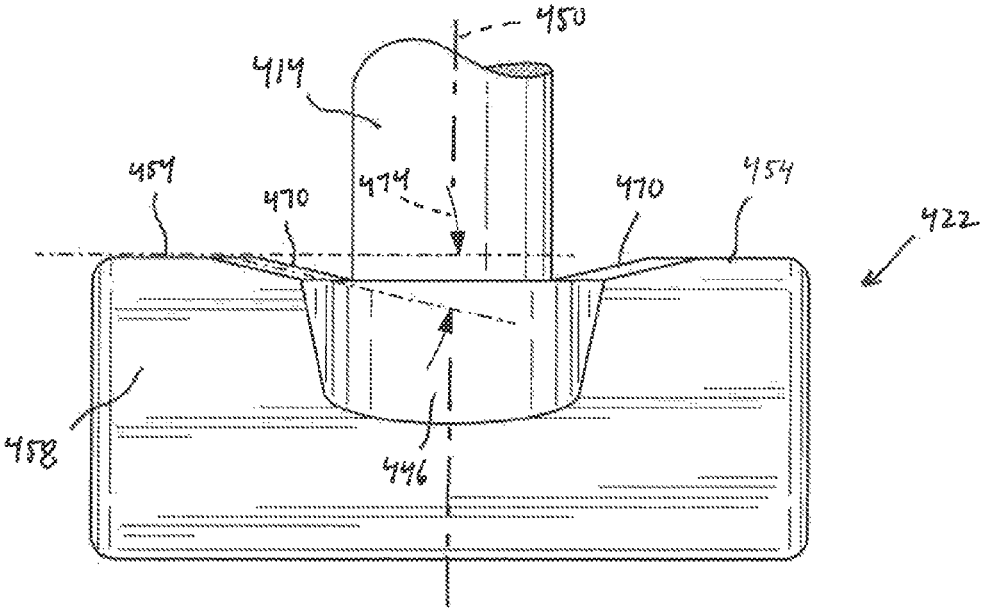
FIG. 12 is a front view of the portion of the extraction tool of FIG. 11 with a body angled upwardly.

Referring to FIGS. 11 and 12, each finger 434 also includes a wedge surface 470. The wedge surface 470 is inclined in multiple dimensions. For example, the wedge surface 470 is inclined downwardly toward the lower surface 458 and toward the first plane 450. The wedge surface 470 defines a maximum height H (FIG. 10) and a maximum length L (FIG. 9). An upper edge of the wedge surface 470 is spaced apart from the first plane 450 by a greater distance than the lower edge of the wedge surface 470. Thus, the wedge surface 470 forms a first or vertical inclination angle 474 (FIG. 12) relative to the upper surface 454. In some embodiments, the vertical inclination angle 474 of the wedge surface 470 is between approximately 5 degrees and approximately 30 degrees. In some embodiments, the vertical inclination angle 474 is between approximately 10 degrees and approximately 25 degrees. In some embodiments, the vertical inclination angle 474 is between approximately 10 degrees and approximately 15 degrees. In some embodiments, the vertical inclination angle 474 is approximately 13 degrees.

In addition, as best shown in FIG. 9, the wedge surface 470 extends along an axis 476 that is inclined inwardly toward the first plane 450 from the distal end 442 to the base end 438. That is, a portion of the wedge surface 470 adjacent the distal end 442 is spaced apart from the first plane 450 by a greater distance than a corresponding portion of the wedge surface 470 proximate the base end 438. Thus, the axis 476 of the wedge surface 470 forms a second or lateral inclination angle 478 relative to the first plane 450. In some embodiments, the lateral inclination angle 478 is between approximately 2 degrees and approximately 20 degrees. In some embodiments, the lateral inclination angle 478 is between approximately 5 degrees and approximately 10 degrees. In some embodiments, the lateral inclination angle 478 is approximately 6 degrees.

Figure 13:
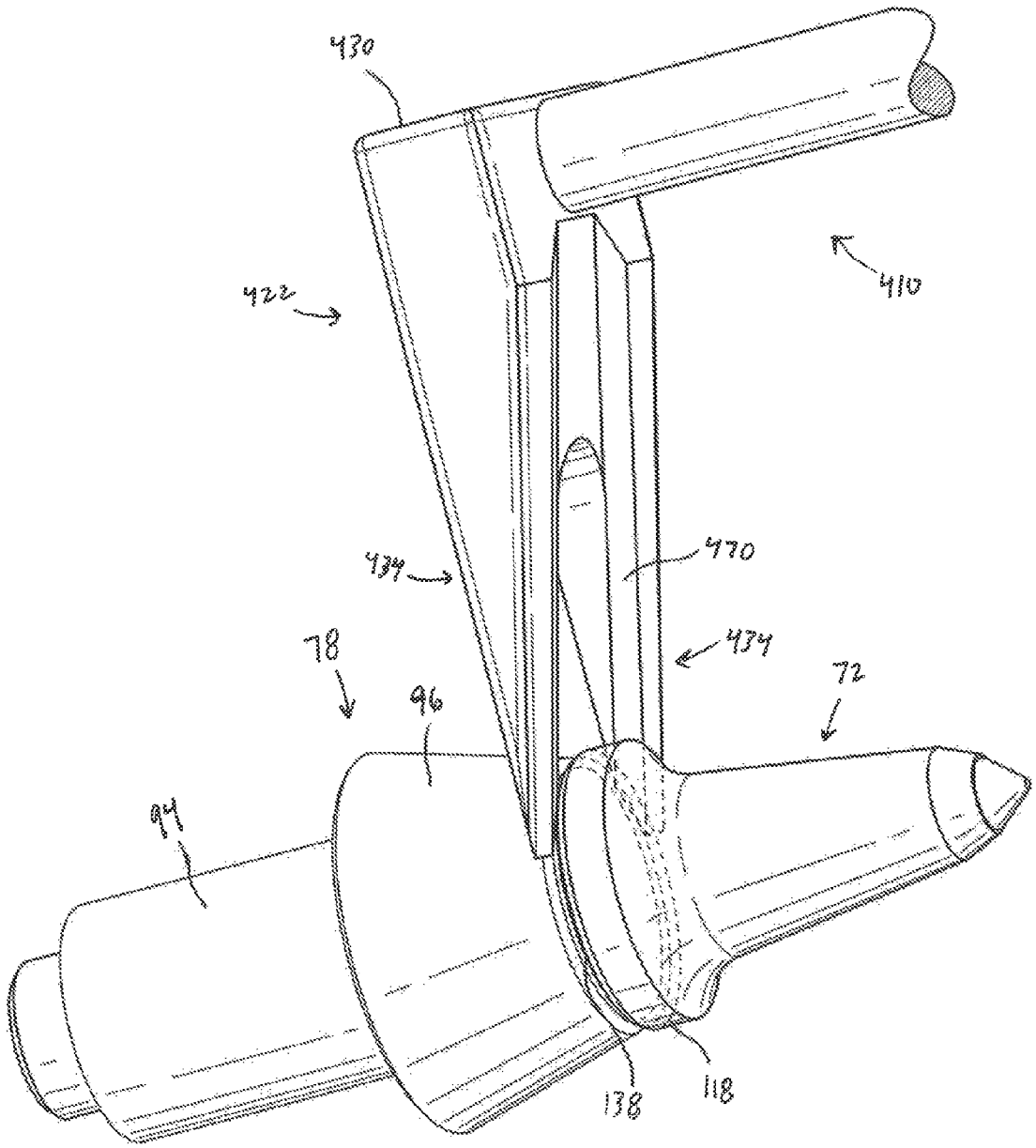
FIG. 13 is a perspective view of the extraction tool of FIG. 8 engaging a cutting bit in a first position.
Figure 14:
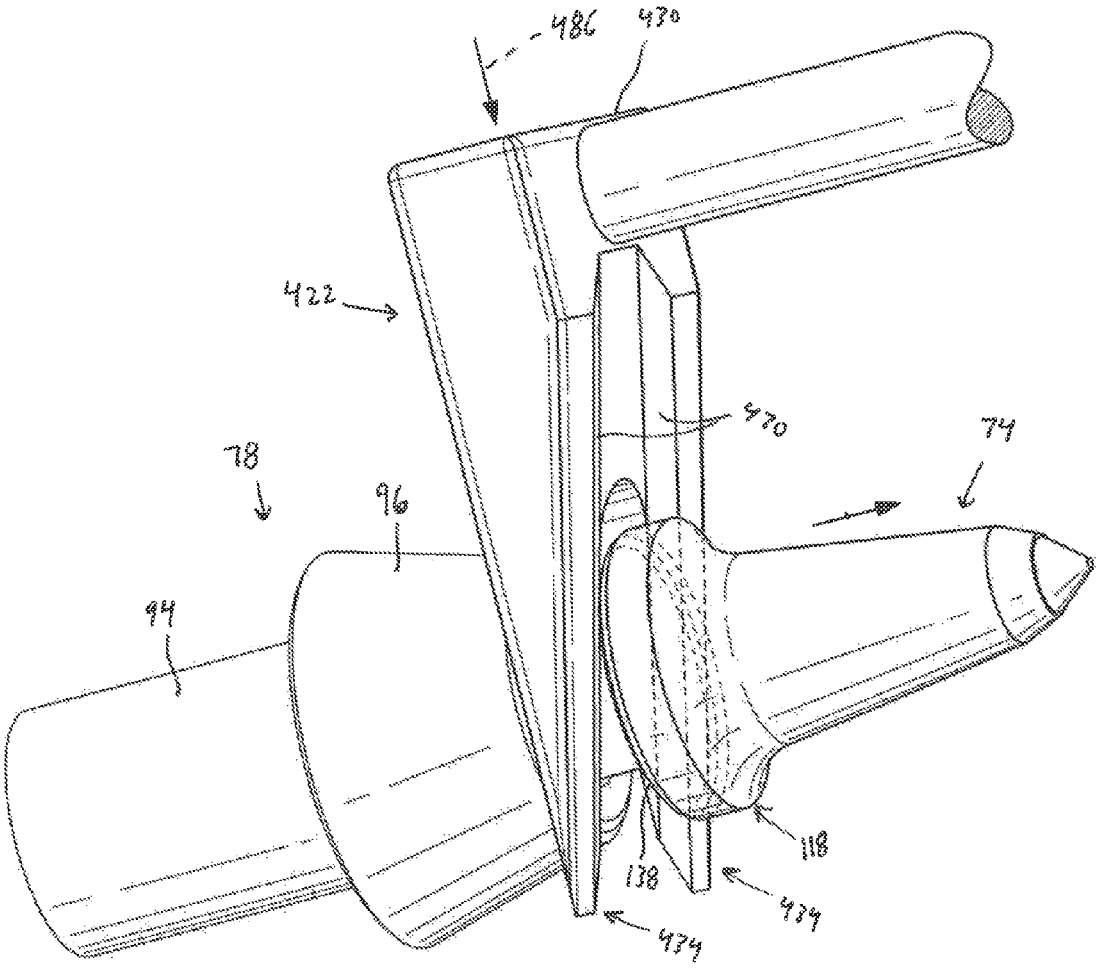
FIG. 14 is a perspective view of the extraction tool of FIG. 8 engaging the cutting bit of FIG. 13 in a second position.

FIGS. 13 and 14 illustrated the process for extracting the bit 74 from the sleeve 78. As shown in FIG. 13, the extraction tool 410 is first positioned such that the fingers 434 are disposed on either side of the bit 74. The wedge surfaces 470 of the fingers 434 are positioned to pass between the shoulder 118 and the flange 96 of the sleeve 78, contacting the second inclined surface 138 on opposing sides of the bit 74. As shown in FIG. 14, an impact force is applied against the face end surface 430 in the direction of arrow 486. Due to the angle of the wedge surface 470 and the length and height of the wedge surface 470 in multiple dimensions, the force transmitted to the second inclined surface 138 is multiplied by a factor corresponding to the dimensions of the wedge surface 470. The bit 74 moves out of the bore of the sleeve 78 and separate from the sleeve 78.

Although aspects of the cutting bit assembly 66 have been described in the context of a mining machine, it is understood that the cutting bit assembly 66 could be incorporated into other types of machines having earth-engaging attachments, including other types of mining machines, construction machines, and road milling machines.

Although aspects have been described in detail with reference to certain preferred embodiments, variations and modifications exist within the scope and spirit of one or more independent aspects as described.

We claim:

1. A bit assembly for a cutting drum, the bit assembly comprising:

a sleeve including shank portion, a flange positioned adjacent an end of the shank portion, and a bore extending through the flange and the shank portion, the flange including a flange end surface; and a bit including a cutting end, a shank, and a shoulder positioned between the cutting end and the shank, at least a portion of the shank positioned within the bore of the sleeve, the shank extending along a bit axis, the shoulder positioned adjacent the end surface of the flange and including an edge, a shoulder end surface defining a shoulder plane, a first inclined surface, and a second inclined surface, the edge extending along a perimeter of the shoulder, the first inclined surface positioned between the edge and the shoulder end surface, the first inclined surface extending along the perimeter of the shoulder and oriented at a first angle relative to the shoulder plane, the second inclined surface positioned between the shoulder end surface and the first inclined surface, the second inclined surface oriented at a second angle relative to the shoulder plane, the first angle being larger than the second angle, wherein the flange end surface abuts the shoulder end surface, the flange further including a third inclined surface positioned adjacent an edge of the flange end surface and extending along a perimeter of the flange end surface, the third inclined surface oriented at a third angle relative to the shoulder plane, wherein the flange further includes a fourth inclined surface positioned adjacent the third inclined surface and oriented at a fourth angle relative to the shoulder plane, wherein the third inclined surface is positioned between the flange end surface and the fourth inclined surface, wherein the third angle is equal to the second angle and the fourth angle is equal to the first angle.

2. The bit assembly of claim 1, wherein the second angle is between approximately 5 degree and approximately 30 degrees.

3. The bit assembly of claim 2, wherein the second angle is between approximately 5 degrees and approximately 20 degrees.

4. The bit assembly of claim 3, wherein the second angle is between approximately 10 degrees and approximately 15 degrees.

5. The bit assembly of claim 4, wherein the second angle is approximately 11 degrees.

6. The bit assembly of claim 1, wherein the first angle is between approximately 45 degrees and 80 degrees.

7. The bit assembly of claim 6, wherein the first angle is between approximately 60 degrees and approximately 70 degrees.

8. The bit assembly of claim 7, wherein the first angle is approximately 65 degrees.

9. The bit assembly of claim 1, wherein the second inclined surface is adjacent to and extends along a perimeter of the shoulder end surface.

10. The bit assembly of claim 1, wherein the second inclined surface and the third inclined surface are positioned adjacent one another and on opposite sides of the shoulder plane, the second angle and the third angle form a combined wedge angle between approximately 20 degrees and approximately 45 degrees.

11. The bit assembly of claim 10, wherein the combined wedge angle is approximately 22 degrees.

12. The bit assembly of claim 1, wherein the first inclined surface is frustoconical and the second inclined surface is frustoconical.

13. The bit assembly of claim 1, wherein the third inclined surface extends away from the second inclined surface, and the fourth inclined surface extends away from the first inclined surface.

14. A cutting bit for a bit assembly secured to a cutter head, the cutting bit comprising:

a cutting end;

a shank extending along a bit axis; and a shoulder positioned between the cutting end and the shank, the shoulder including an outer edge defining a perimeter, a shoulder end surface defining a shoulder plane, a first inclined frustoconical surface positioned between the outer edge and the shoulder end surface, the first inclined frustoconical surface extending along the perimeter and oriented at a first acute angle relative to the shoulder plane, and a second inclined frustoconical surface positioned between the shoulder end surface and the first inclined frustoconical surface, the second inclined frustoconical surface oriented at a second acute angle relative to the shoulder plane, the second acute angle being smaller than the first acute angle.

15. The cutting bit of claim 14, wherein the second angle is between approximately 1 degree and approximately 30 degrees.

16. The cutting bit of claim 15, wherein the second angle is between approximately 10 degrees and approximately 25 degrees.

17. The cutting bit of claim 16, wherein the second angle is approximately 11 degrees.

18. The cutting bit of claim 14, wherein the first angle is between approximately 45 degrees and 80 degrees.

19. The cutting bit of claim 18, wherein the first angle is between approximately 60 degrees and approximately 70 degrees.

20. The cutting bit of claim 19, wherein the first angle is approximately 65 degrees.

21. The cutting bit of claim 14, wherein the second inclined frustoconical surface is directly adjacent to the shoulder end surface and extends along a perimeter of the shoulder end surface.

22. A bit assembly for a cutting drum, the bit assembly comprising:

a sleeve including shank portion, a flange positioned adjacent an end of the shank portion, and a bore extending through the flange and the shank portion, the flange including a flange end surface; and a bit including a cutting end, a shank, and a shoulder positioned between the cutting end and the shank, at least a portion of the shank positioned within the bore of the sleeve, the shank extending along a bit axis, the shoulder positioned adjacent the end surface of the flange and including an edge, a shoulder end surface defining a shoulder plane, a first inclined frustoconical surface, and a second inclined frustoconical surface, the edge extending along a perimeter of the shoulder, the first inclined frustoconical surface positioned between the edge and the shoulder end surface, the first inclined frustoconical surface extending along the perimeter of the shoulder and oriented at a first angle relative to the shoulder plane, the second inclined frustoconical surface positioned between the shoulder end surface and the first inclined frustoconical surface, the second inclined frustoconical surface oriented at a second angle relative to the shoulder plane, the first angle being larger than the second angle.

23. The bit assembly of claim 22, wherein the second angle is between approximately 5 degree and approximately 30 degrees.

24. The bit assembly of claim 23, wherein the second angle is between approximately 5 degrees and approximately 20 degrees.

25. The bit assembly of claim 24, wherein the second angle is between approximately 10 degrees and approximately 15 degrees.

26. The bit assembly of claim 25, wherein the second angle is approximately 11 degrees.

27. The bit assembly of claim 22, wherein the first angle is between approximately 45 degrees and 80 degrees.

28. The bit assembly of claim 27, wherein the first angle is between approximately 60 degrees and approximately 70 degrees.

29. The bit assembly of claim 28, wherein the first angle is approximately 65 degrees.

30. The bit assembly of claim 22, wherein the second inclined frustoconical surface is adjacent to and extends along a perimeter of the shoulder end surface.

31. The bit assembly of claim 22, wherein the flange end surface abuts the shoulder end surface, the flange further including a third inclined surface positioned adjacent an edge of the flange end surface and extending along a perimeter of the flange end surface, the third inclined surface oriented at a third angle relative to the shoulder plane.

32. The bit assembly of claim 31, wherein the second inclined frustoconical surface and the third inclined surface are positioned adjacent one another and on opposite sides of the shoulder plane, the second angle and the third angle form a combined wedge angle between approximately 20 degrees and approximately 45 degrees.

33. The bit assembly of claim 32, wherein the combined wedge angle is approximately 22 degrees.

* * * * *